United States Patent [19]

Crino

[11] Patent Number: 4,788,390

[45] Date of Patent: Nov. 29, 1988

[54] SHUNT CAPACITOR SWITCH WITH AN IMPEDANCE INSERTION ELEMENT

[75] Inventor: Arthur D. Crino, Portland, Oreg.

[73] Assignee: Siemens Energy & Automation, Inc., Atlanta, Ga.

[21] Appl. No.: 186,412

[22] Filed: Apr. 26, 1988

[51] Int. Cl.[4] ..... H01H 33/16

[52] U.S. Cl. ..... 200/144 AP; 200/148 A

[58] Field of Search ..... 200/144 AP

[56] References Cited

U.S. PATENT DOCUMENTS

| | | | |
|---|---|---|---|
| 3,143,622 | 8/1964 | Fischer | 200/144 AP |
| 3,291,947 | 12/1966 | Van Sickle | 200/144 AP |
| 3,576,414 | 4/1971 | Mikos | 200/144 AP |
| 3,636,292 | 1/1972 | Roth | 200/144 AP |
| 3,674,956 | 7/1972 | Erni | 200/148 A |
| 4,204,101 | 5/1980 | Dethlefsen | 200/144 AP |
| 4,434,332 | 2/1984 | Yanabu et al. | 200/144 AP |
| 4,488,021 | 12/1984 | Yoshizumi | 200/144 AP |
| 4,500,762 | 2/1985 | Yoshizumi | 200/144 AP |
| 4,568,806 | 2/1986 | Frink | 200/148 A |

FOREIGN PATENT DOCUMENTS

| | | |
|---|---|---|
| 868020 | 2/1953 | Fed. Rep. of Germany . |
| 880010 | 6/1953 | Fed. Rep. of Germany . |
| 1069255 | 11/1959 | Fed. Rep. of Germany . |
| 2755834 | 12/1977 | Fed. Rep. of Germany . |
| 963331 | 12/1949 | France . |
| 645094 | 5/1948 | United Kingdom . |

*Primary Examiner*—Robert S. Macon

*Attorney, Agent, or Firm*—James G. Morrow

[57] ABSTRACT

A high voltage switch for switching capacitor banks in and out of a circuit. The switch includes two sets of contacts to perform the switching function. An impedance element is connected in parallel with one set of contacts. Upon closing of the switch current is caused to flow through the impedance element and one set of contacts, thereby preventing the switch from functioning as a short circuit. Subsequently, the second set of contacts engages and the switch can function as a short circuit to completely switch a capacitor bank into the circuit.

20 Claims, 3 Drawing Sheets

SHUNT CAPACITOR SWITCH WITH AN IMPEDANCE INSERTION ELEMENT

BACKGROUND OF THE INVENTION

This invention relates to high voltage switching apparatus, and more particularly to a shunt capacitor switch having multiple arc regions, wherein one of the arc regions is connected in parallel with an impedance. This invention relates to a modification of the construction disclosed in U.S. Pat. No. 4,568,806 issued on Feb. 3, 1986 to Russell E. Frink. U.S. Pat. No. 4,568,806 relates to a puffer circuit interrupter with enhanced power handling capability.

Shunt capacitor banks are used to modulate or control the voltage levels on electric utility systems. Since the voltage level of a utility system varies from one part of a day to another, the capacitor banks are switched frequently. The energization of capacitor banks can result in high phase-to-phase surges in power system. When a capacitor bank is switched into a power system for purposes of energizing the capacitor bank, the capacitor bank initially draws a very high current from the system. This initially high current draw is due to the characteristic of an unenergized or uncharged capacitor to initially function similar to a zero resistance electrical element and subsequently function as a high resistance electrical element as it becomes fully energized.

Shunt capacitor banks are frequently switched by conventional circuit breakers, vacuum switches and circuit switches without any resistor or reactor pre-insertion capability. These devices are known to generate high levels of transient over voltages during the closing of the circuit for switching capacitor banks. Under certain circumstances, these transients may cause severe damage to costly equipment at substations where the capacitor bank are switched and at locations in utility systems other than the substations. Normally, equipment damaged includes power transformers and, in some cases, the capacitors and substation control circuitry.

Shunt capacitor banks are also switched by circuit switcher with resistor or reactor pre-insertion capability. These devices are widely used, but are generally recognized as not having 100% probability of performing as intended. Additionally, these devices periodically fail to commutate the arc through the resistor or reactor. Furthermore, upon closing, the pre-strike arc in air generates a loud noise. (See the HIGH VOLTAGE SWITCH WITH PRE-INSERSION RESISTOR of U.S. Pat. No. 3,576,414.)

In light of these problems it can be seen that it would be highly desirable to have a switching device adapted to initially impead the high current flow into a capacitor bank during energization.

SUMMARY OF THE INVENTION

The present invention is provided to overcome one or more of the problems set forth above. Accordingly, the present invention provides for a shunt capacitor switch including an insulating tube means having a first, second and third external terminal means disposed within the insulating tube means and a first and a second tube section, wherein the external terminal means are adapted to communicate with the internal portion of the insulating tube means. The first external terminal means is in electrical contact with a first electrical contact means, the second external contact means is in electrical contact with the third electrical contact means and the third external contact means is in contact with the second electrical contact means. The third electrical contact means is adapted to electrically engage the first and second electrical contact means and also move relative to the first and second electrical contact means. An impedance means is coupled between the second electrical contact means and the third electrical contact means such that current can flow through the circuit interrupter when the second electrical contact means is electrically disengated from the third electrical contact means. The shunt capacitor switch also includes a volume of insulative gas. One embodiment of the shunt capacitor switch includes fluid motor means. The fluid motor means is disposed upon the first contact means, and defines a chamber. The fluid motor means includes an opening therein which controllably communicates with a first arc region between the first and third contact means and a second arc region between the second and third contact means. The gas is forced to flow from the chamber through the opening into the first arc region as the first contact means disengages from the third contact means and serially into the second arc region as the second contact means disengages the third contact means to affect an arc between the second and third contact means.

An object of the present invention is to reduce transient over voltages when capacitor banks are switched on to control the voltage levels on electric utility systems. The reduction of transient over voltages serves to increase the lives of the capacitors, reduce the risk of damage to transformers and reduce the risk of inducing harmful voltage spikes in station control circuitry. Protection from voltage spikes in station control circuitry also reduces the need for protective measures in the control circuitry.

BRIEF DESCRIPTION OF THE DRAWINGS

The preferred embodiment of the invention will be described with reference to the accompanying drawings wherein.

DETAILED DESCRIPTION OF THE PREFERRED EMBODIMENT

Figure 1:
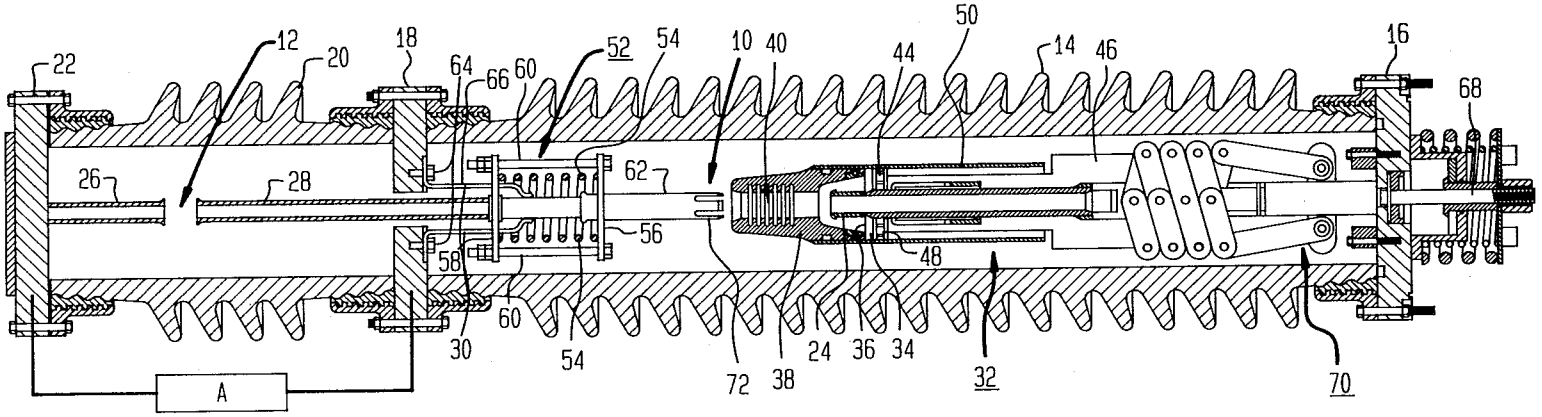
FIG. 1 is a side view of the shunt capacitor switch in accordance with the preferred embodiment of the invention having all electrical contacts engaged.

Referring to FIG. 1, an embodiment of a shunt capacitor switch with an impedance element A is shown. The shunt capacitor switch has a first arc region 10 and a second arc region 12. The shunt capacitor switch includes a first insulating tube 14 closed at each end by a first metallic terminal end plate 16, and a second metallic terminal end plate 18. The switch also includes a second insulating tube 20, closed at one end by the second terminal 18 and closed at the other end by a third metallic terminal end plate 22, and an impedance element A. The first and third terminals 16, 22 provide electrical connections and physical support to the internal workings of the switch. The first and third external terminals 16, 22 also serve as terminals for connecting the switch to a main circuit and a shunt capacitor bank.

A first electrical contact 24, preferably a tubular elongated movable venting contact, is located within the first insulating tube 14 and electrically connected to the first external terminal 16. A second electrical contact 26, preferably a tubular stationary venting contact, is located within the second insulating tube 20 and electrically connected to the third external terminal 22. A third electrical contact 28, preferably a tubular elongated follow contact, is located within the insulating tubes 14, 20. The third electrical contact 28 is movable relative to the first contact 24 into and out of electrical engagement therewith and is movable relative to the second contact 26 into and out of electrical engagement therewith. Electrical contact slides 30 allow the third electrical contact 28 to move relative to the second external terminal 18.

Figure 2:
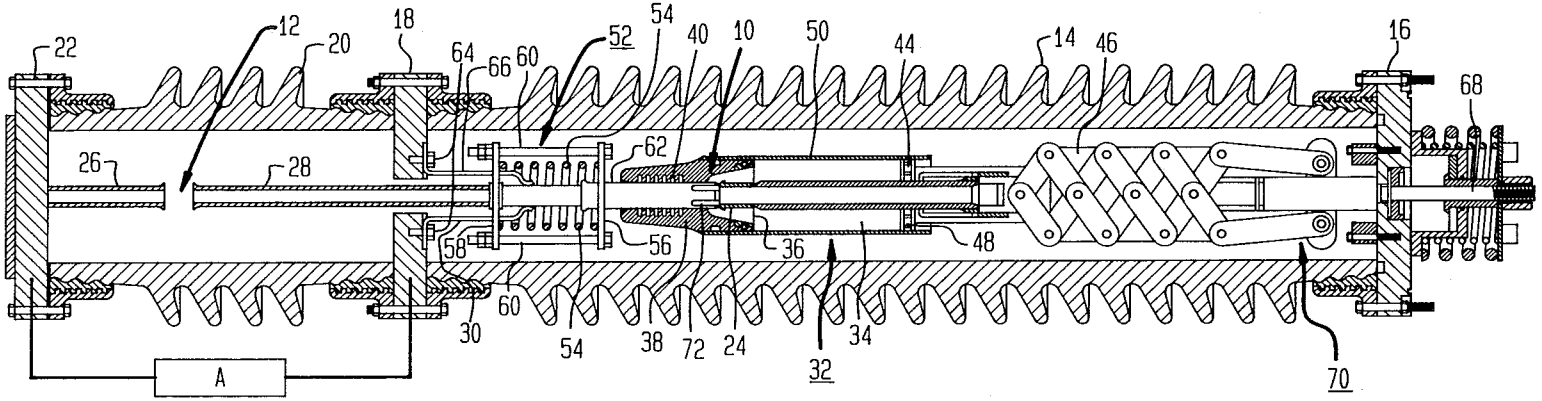
FIG. 2 is a side view of the shunt capacitor switch having only one set of electrical contacts engaged.
Figure 3:
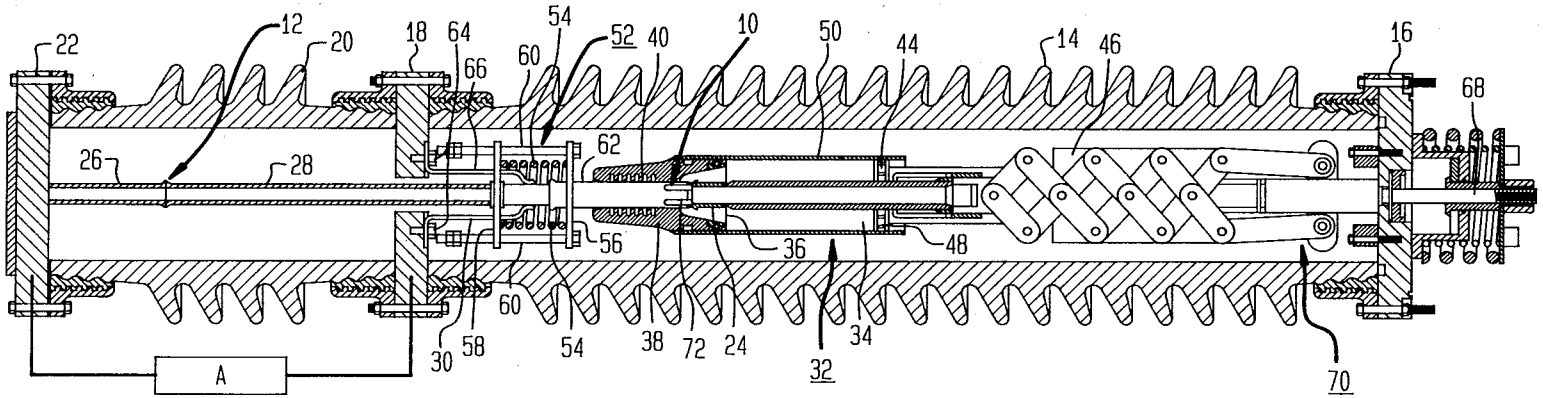
FIG. 3 is a side view of the shunt capacitor switch having all electrical contacts disengaged.

Referring to FIGS. 1–3, an impedance element A is shown to be electrically coupled to the second external terminal 18 and third external terminal 22. Since the external terminal 18 is in electrically coupled with the third electrical contact 28, a current can flow through the impedance element A while the first contact 24 and third contact 28 are engaged and the second and third contacts 26, 28 are disengaged. A resistor or reactor can serve as the impedance element. By way of illustration, and with no limitations intended an impedance from 40 to 50 ohms at a frequency of 60 cycles per second has been used with 69 to 161 kilovolt shunt capacitor banks.

When a capacitor bank is inserted into a main circuit with the switch, the contacts 24, 26, 28 of the switch close such that the first and third contacts 24, 28 are electrically engaged before the second and third contacts 26, 28. Since the capacitor banks act substantially similar to a zero resistance circuit when initially inserted into the main circuit, a very large current flow would normally occur upon engagement of the second and third contacts 24, 28. The impedance element A serves to impead or resist this very large current flow since the capacitor bank is initially engaged to the switch such that the current must flow through the impedance element A until the second and third contacts 26, 28 are electrically engaged. FIG. 2 illustrates the configuration of the switch wherein the current must flow through the impedance element A.

In some situations it may be desirable to have means for extinguishing an arc when the contacts are disengaged, therefore, in one embodiment of the invention, a fluid motor 32 is mounted about the first contact 24. The fluid motor 32 has a chamber 34 which controllably communicates gas, preferably sulfur hexafluoride, through an opening 36. When the switch is opened, the gas within the chamber 34 is forced to flow from the chamber 34 through the opening 36 into the first arc region 10 as the first contact 24 disengages from the third contact 28 to extinguish an arc between the first and third contacts 24, 28, and then serially into the second arc region 12 to extinguish an arc between the second and third contacts 26, 28.

The first electrical contact 24 preferably has an insulating nozzle 38 fixed thereon which surrounds one end of the first electrical contact 24 and the third electrical contact 28 upon engagement of the contacts 24, 28 and effects a sliding gas-seal therebetween. Preferably, the insulating nozzle 38 directs the flow of insulative gas into the first arc region 10 to extinguish an arc therein. A cooler may be mounted inside the insulating nozzle 38 to cool the gas as it flows across it. The insulating nozzle 38 has annular ridges 40 on its inside surface to prevent arc creepage between the first electrical contact 24 and the third electrical contact 28 when the circuit is opened.

Referring to FIGS. 1–3, the fluid motor 32 preferably has a piston 44, attached to first terminal 16 by an extension guide 46, located concentrically about the first electrical contact 24 effecting a sliding gas-seal therewith. The piston 44 preferably has at least one one-way valve 48 allowing the fluid motor 32 to fill with gas during circuit closing. The valve blocks gas passage during circuit opening. Preferably the fluid motor 32 has a movable cylinder 50 attached to the first contact 24 forming the chamber 34. The chamber 34 is filled with gas in the circuit-closed position. The chamber 34 decreases in volume with the progression of the circuit-opening motion compressing the gas until the valve-like abutting contact (see FIGS. 2 and 3) between the first and third contacts 24, 28 is separated allowing the gas to escape from the chamber 34 through the opening 36.

The switch preferably has a lost-motion mechanism 52 fastened to the second terminal 18 and the third electrical contact 28. The lost-motion mechanism 52 includes a spring 54, a first washer 56, a second washer 58, spring guide bolts 60, and a conductor 62 fixed to the third electrical contact 28. The spring guide bolts 60 direct and limit spring 54 expansion during circuit opening. The first washer 56 is mounted relative to the second terminal 18 with mounting bolts 64 and spacer 66.

Preferably, the first electrical contact 24 and third electrical contact 28 have annular electrical contact end portions with the third electrical contact 28 having slotted flexible portions 72.

In operation, a conductive path is initially provided through the first terminal 16, through the first electrical contact 24, through the third electrical contact, through the impedance element A and through third terminal 22. When the switch contacts 24, 26, 28 are completely closed the third electrical contact 28 communicates directly with the second electrical contact 26 thereby reducing the overall impedance of the switch.

During circuit closing, the improved capabilities of this invention are shown. As the shaft 68 is pushed toward the first external terminal, the stroke multiplying linkage ("lazy tongs") mechanism 70 extends the first electrical contact 24 toward the third electrical contact 28, as the first electrical contact 24 is extended it electrically engages the third electrical contact 28 and current is allowed to flow through these contacts 24, 28 and the impedance element A, thereby charging the capacitors of the capacitor bank. As the first electrical contact 24 is extended further, the lost-motion mechanism 52 is compressed and the third electrical contact 28 electrically engages the second electrical contact 26, thereby fully engaging the capacitor bank into the main electrical circuit.

As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the spirit and script of the invention.

I claim:

1. A high voltage shunt capacitor switching apparatus comprising:

an insulating tube means having a first and a second terminal means, the terminal means communicating with the internal portion of the insulating tube means;

a first electrical contact means in electrical contact with the first terminal means;

a second electrical contact means;

a third electrical contact means for electrically engaging the first and second electrical contact means and adapted to move relative to the first and second electrical contact means;

volume of insulative gas;

a third terminal means, the third terminal means communicating with the internal portion of the insulating tube means, wherein the insulating tube means includes a first and a second tube section, the second electrical contact means being in electrical contact with the third terminal means, the third electrical contact means being in electrical contact with the second terminal means and the first, second and third contact means being disposed within the insulating tube means; and an impedance means coupled between the second electrical contact means and the third electrical contact means such that current can flow through the shunt capacitor switch when the second electrical contact means is disengaged from the third electrical contact means.

2. The apparatus of claim 1, wherein the impedance means comprises a resistor.

3. The apparatus of claim 1, wherein the impedance means comprises a reactor.

4. The apparatus of claim 1, wherein the third electrical contact means is of tubular construction.

5. The apparatus of claim 4, wherein the third electrical contact means has an annular electrical contact at least one end.

6. The apparatus of claim 4, wherein the third electrical contact means has slotted flexible portions on one end thereof to effect a mechanical biasing force against the respective engaging contact when engaged.

7. The apparatus of claim 1, further comprising:

a fluid motor means disposed about the first contact means, the fluid motor means defining a chamber and having an opening therein which communicates with a first arc region between the first and third contact means and a second arc region between the second and third contact means, gas being forced to flow from the chamber through the opening into the first arc region as the first contact means disengages from the third contact means and serially into the second arc region as the second contact means disengages the third contact means to affect an arc between the second and third contact means.

8. The apparatus of claim 7, further comprising an insulating nozzle means affixed to the first electrical contact and adapted to concentrically surround one end of the first and third contacts to effect a slidable gas seal therebetween, wherein the insulating nozzle means directs the flow of gas from the fluid motor into the first arc region to extinguish the arc therein.

9. The apparatus of claim 8, wherein the insulating nozzle means has annular ridges on its inside surface spaced to prevent arc creepage.

10. The apparatus of claim 9, wherein the fluid motor means has a piston attached to the interior of the first terminal means and disposed concentrically about the first electrical contact means effecting a sliding gas-seal contact therewith, the piston having at least one one-way valve allowing the puffer gas to be drawn into the fluid motor means during engagement motion of the contacts and blocking puffer gas passage through the valves at other times.

11. The apparatus of claim 10, wherein the fluid motor means includes a movable cylinder attached to the first contact means, define wherein the chamber is filled with puffer gas at substantially the same pressure as the puffer gas residing in the remainder of the insulating tube means when all contacts are engaged, the chamber decreasing in volume with the progression of the disengagement motion compressing the puffer gas therein trapped by the one-way valves and the seal between the first and third contact until the first and third contacts separate allowing the compressed puffer gas to escape.

12. The apparatus of claim 1, further comprising a lost-motion means being fastened to the second terminal means and affixed to the third contact means.

13. The apparatus of claim 12, wherein the lost motion means includes:

a spring;

a washer disposed concentrically about and fastened to the third contact; and a spring guide having a spring extension limit means and operating during contact disengagement to keep the third contact engaged with the first contact until the spring extension limit is met causing a cessation of the lost-motion action and separating the third and first contacts.

14. A high voltage hunt capacitor switching apparatus comprising:

a first insulating tube including a first and a second terminal, the terminals communicating with the internal portion of the insulating tube;

a first electrical contact disposed within the first insulating tube in electrical contact with the first external terminal;

a second electrical contact;

a third electrical contact for electrically engaging the first and second electrical contacts and adapted to move relative to the first and second electrical contact;

a volume of insulative gas;

a second insulating tube having a third external terminal, the third external terminal communicating with the internal portion of the second insulating tube, the second electrical contact being in electrical contact with the third external terminal and disposed within the second insulating tube, the third electrical contact being in electrical contact with the second external terminal and disposed within the first and second insulating tubes; and an impedance means in electrical contact with the second electrical contact and the third electrical contact such there is a flow of current through the shunt capacitor switch when the second electrical contact is disengaged from the third electrical contact and the first electrical contact is engaged with the third electrical contact.

15. The apparatus of claim 14, wherein the impedance means comprises a resistor.

16. The apparatus of claim 14, wherein the impedance means comprises a reactor.

17. The apparatus of claim 14, wherein the third electrical contact means has an annular electrical contact at least one end.

18. The apparatus of claim 17, wherein the third electrical contact means has slotted flexible contacts on one end thereof to effect a mechanical biasing force against the respective engaging contact when engaged.

19. The apparatus of claim 14, further comprising a lost-motion means being fastened to the second external terminal means and affixed to the third contact means.

20. The apparatus of claim 14, further comprising:

a fluid pump disposed upon the first electrical contact, the fluid pump defining a chamber and having an opening therein which communicates with a first arc region between the first and third contact and a second arc region between the second and third contact, the fluid pump being adapted to force gas from the chamber through the opening into the first arc region as the first contact disengages from the third contact and serially into the second arc region as the second contact disengages the third contact, the gas affecting arcs at the first and second arc regions.

* * * * *